US005784754A

United States Patent [19]

Roden et al.

[11] Patent Number: 5,784,754

[45] Date of Patent: Jul. 28, 1998

[54] SURFACE CLEANING APPLIANCE

[75] Inventors: Michael J. Roden, Prescott; Steven S. Wickert, Prescott Valley, both of Ariz.

[73] Assignee: Professional Chemicals Corporation, Chandler, Ariz.

[21] Appl. No.: 874,535

[22] Filed: Jun. 13, 1997

[51] Int. Cl.[6] ..... A47L 5/30

[52] U.S. Cl. ..... 15/320; 15/321; 15/385

[58] Field of Search ..... 15/320, 321, 322, 15/385

[56] References Cited

U.S. PATENT DOCUMENTS

| | | | |
|---|---|---|---|
| 4,182,001 | 1/1980 | Krause | 15/320 |
| 4,692,959 | 9/1987 | Monson | 15/320 |
| 5,463,791 | 11/1995 | Roden | 15/320 |

FOREIGN PATENT DOCUMENTS

| | | | |
|---|---|---|---|
| 576560 | 5/1933 | Germany | 15/385 |
| 1503748 | 4/1969 | Germany | 15/344 |

*Primary Examiner*—Chris K. Moore

*Attorney, Agent, or Firm*—Cahill, Sutton & Thomas P.L.C.

[57] ABSTRACT

A drive system for a surface cleaning appliance having a pair of rotatable head structures employs a worm gear positioned between the head structure in engagement with two spur gears on, respectively, the two head structures.

2 Claims, 2 Drawing Sheets

SURFACE CLEANING APPLIANCE

TECHNICAL FIELD

This invention is concerned with improving the drive train for a surface cleaning appliance having a pair of rotatable head structures for spraying and vacuuming the surface.

BACKGROUND ART

My U.S. Pat. No. 5,463,791 granted Nov. 7, 1995 for "Surface Cleaning Appliance" discloses the type of apparatus to which this invention is applicable.

The drive train from the motor to the rotating heads for the appliance of the '791 patent is fairly complex and costly to produce. It includes a gear box for speed reduction, a belt drive for one of the rotating heads and a spur gear arrangement between the two heads for rotating the non-belt-driven head.

DISCLOSURE OF THE INVENTION

This invention envisions driving both heads by a worm gear positioned between the rotating heads and meshing with a spur gear on each head. The worm gear drive further serves as a speed reduction device thus eliminating the need for a separate reduction gear.

BRIEF DESCRIPTION OF THE DRAWINGS

The invention is described in greater detail hereinafter by reference to the accompanying drawings, wherein.

BEST MODE FOR CARRYING OUT THE INVENTION

Figure 1:
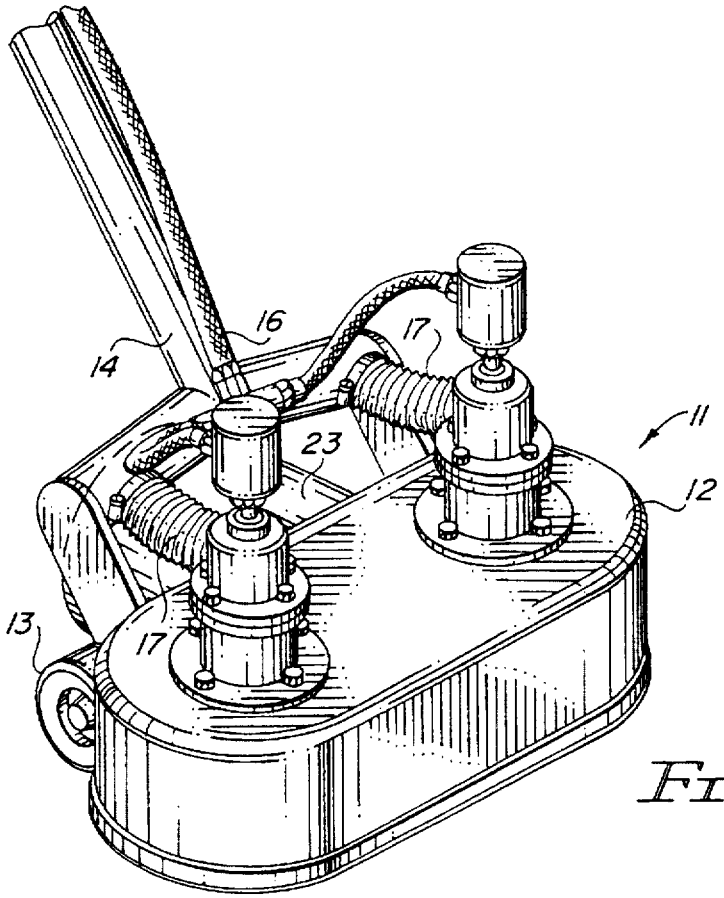
FIG. 1 is a perspective view of the housing portion of a surface cleaning appliance embodying the invention.
Figure 3:
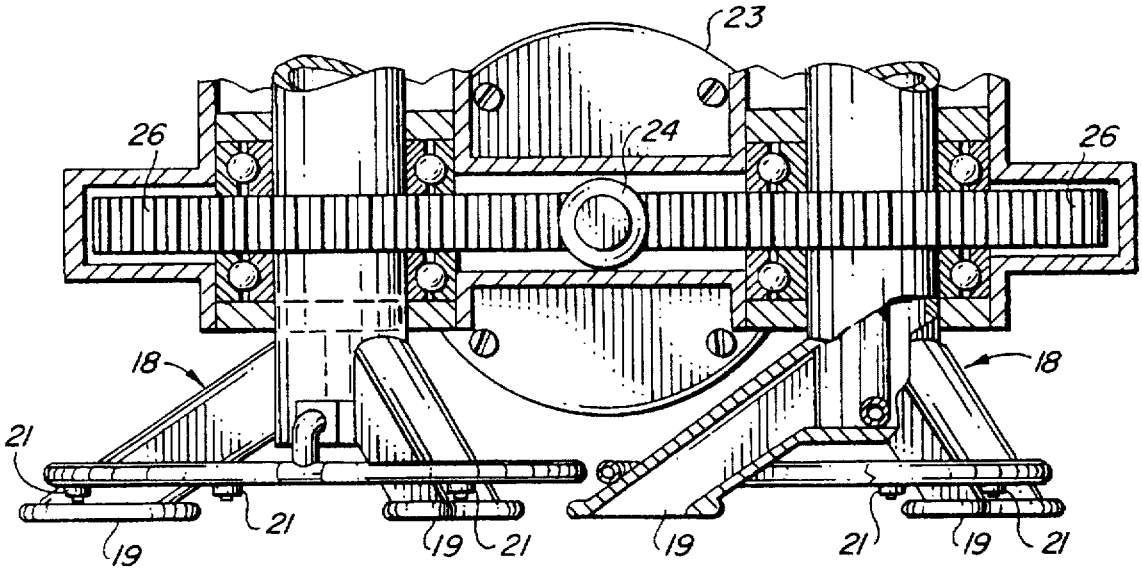
FIG. 3 is a vertical sectional view taken generally as indicated by line 3—3 in FIG. 2 and with portions broken away to illustrate the interior of certain components.

The surface cleaning appliance illustrated in FIG. 1 is designated generally by reference numeral 11. The appliance comprises a housing 12 mounted on wheels 13 for movement across the surface to be cleaned, such as a rug. The appliance is manipulated by a handle 14 attached to the housing.

Cleaning fluid under pressure is supplied to the housing 12 by a hose system 16 and spent fluid and debris are removed from the housing via vacuum hoses 17 connected to hollow handle 14. Hoses 16 and 17 are connected, respectively, to sources of cleaning fluid under pressure and a vacuum, neither of which are shown. Such sources may, for example, be like the system shown and described in U.S. Pat. No. 4,991,254 granted to James R. and Michael J. Roden on Feb. 12, 1991 for "Cleaning System".

The physical act of cleaning a surface is accomplished by a pair of rotating cleaning heads 18 which are mounted in housing 12 for rotation in side-by-side relationship about vertical axes. Each cleaning head 18 comprises, in turn, a plurality of vacuum nozzles 19 and a plurality of spray nozzles 21 interspersed between the vacuum nozzles. The apparatus for conveying cleaning fluid from hose system 16 to spray nozzles 21 and for withdrawing spent fluids and debris from vacuum nozzles 19 to vacuum hoses 17 are not shown in detail for they are not critical to this invention. Such apparatus is shown and described in detail in my aforementioned '791 patent which is incorporated herein by reference.

Figure 2:
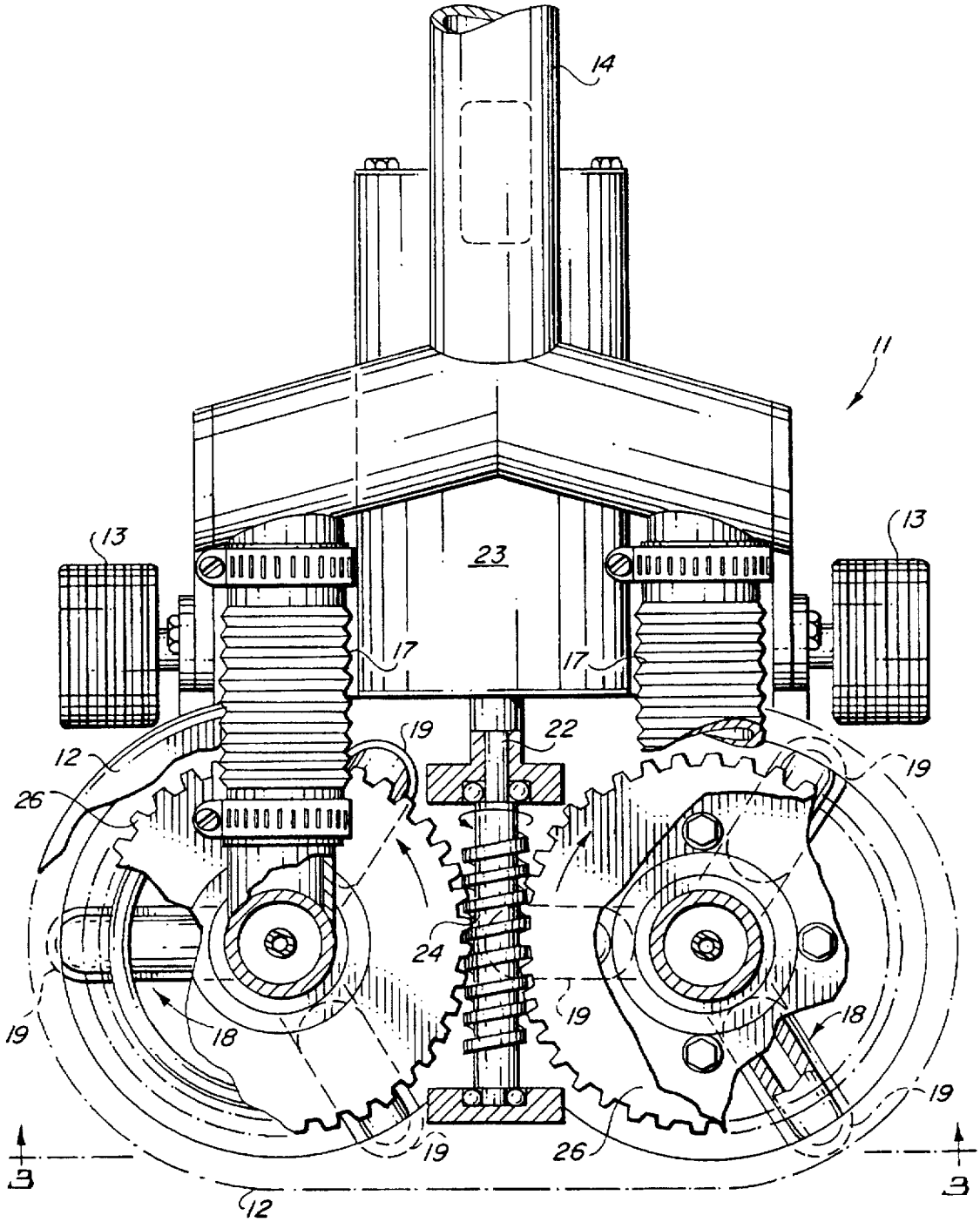
FIG. 2 is a plan view of the appliance of FIG. 1 with portions broken away to show the interior of the housing.

The present invention is primarily concerned with the drive train by which rotation of the shaft 22 of a motor 23 causes rotation of the cleaning heads 18. A key component of this drive train is a worm gear 24 secured to motor shaft 22. Worm gear 24 is positioned horizontally and equidistant between the axes of rotation of cleaning heads 18 for engaging spur gears 26 mounted on those heads. As indicated by the arrows in FIG. 2 rotation of worm gear 24 results in rotation of spur gears 26 and their respective cleaning heads 18 in opposite directions.

The worm gear 24/spur gears 26 drive constitutes a speed reduction device and this is a necessary feature for this type of apparatus in which the cleaning heads 18 are required to rotate at a speed considerably less than the normal rotating speed of the motor shaft 22. Thus, no separate speed reduction unit need be provided as was the case in the apparatus disclosed in my '791 patent.

It should further be noted that the worm gear 24/spur gears 26 drive causes rotation of the cleaning heads 18 to be synchronized at all times. This means that with the vacuum nozzles 19 in one cleaning head 18 angularly offset from the vacuum nozzles of the other head 18 there is no interference between the two sets of vacuum nozzles even though their paths overlap slightly between the heads. The overlap, of course, is desirable to eliminate a strip of untreated surface between the heads 18.

From the foregoing it should be appreciated that this invention provides an improved drive arrangement for dual headed surface cleaning appliances.

What is claimed is:

1. A surface cleaning appliance comprising a housing, a pair of rotatable head structures mounted for rotation about parallel vertical axes in said housing, each of said rotatable head structures comprising at least one spray nozzle for spraying cleaning fluid onto the surface to be cleaned and at least one vacuum nozzle for extracting cleaning fluid and debris from the surface, each of said head structures having a spur gear thereon for rotation with the structure, a worm gear having a substantially horizontal axis positioned between and in engagement with the spur gears, and means for rotating said worm gear to cause rotation of said head structures.

2. The appliance of claim 1 wherein the rotating means is an electric motor.

* * * * *